United States Patent [19]

Notelteirs et al.

[11] 4,069,437

[45] Jan. 17, 1978

[54] INFRARED LAMP WITH HEAT CONDUCTIVE CAP ASSEMBLY AND FIXTURE

[75] Inventors: Victor Rosallie Notelteirs; Josephus Franciscus Rijckaert; Johannes Maria Jozef Ritzen, all of Eindhoven, Netherlands

[73] Assignee: U.S. Philips Corporation, New York, N.Y.

[21] Appl. No.: 676,551

[22] Filed: Apr. 13, 1976

[30] Foreign Application Priority Data

Apr. 16, 1975 Netherlands ..... 7504501

[51] Int. Cl.[2] ..... H01K 7/00

[52] U.S. Cl. ..... 313/315; 219/553; 174/50.64; 313/381; 313/332

[58] Field of Search ..... 313/332, 331, 315; 219/553; 174/50.56, 50.63, 50.64

[56] References Cited

U.S. PATENT DOCUMENTS

| | | | |
|---|---|---|---|
| 2,367,966 | 1/1945 | Schmidt, Jr. | 313/332 X |
| 3,315,116 | 4/1967 | Beese | 313/331 |
| 3,657,592 | 4/1972 | Kellar | 313/332 |
| 3,984,719 | 10/1976 | Grasis et al. | 313/332 |

*Primary Examiner*—Saxfield Chatmon, Jr.
*Attorney, Agent, or Firm*—Frank R. Trifari; Robert S. Smith

[57] ABSTRACT

An infrared tubular incandescent lamp provided with a cap assembly and current supply lead at each pinched end of the lamp vessel. The caps are not electrically conductive and are heat sinks. Each cap assembly includes a formed ceramic member enclosed by a cap with a good heat conductive mass embedded between each pinched lamp seal and its surrounding metal cap. A luminaire for this lamp is provided which contains means resiliently engaging the lamp cap so as to form a heat sink.

6 Claims, 7 Drawing Figures

INFRARED LAMP WITH HEAT CONDUCTIVE CAP ASSEMBLY AND FIXTURE

Figure 1:
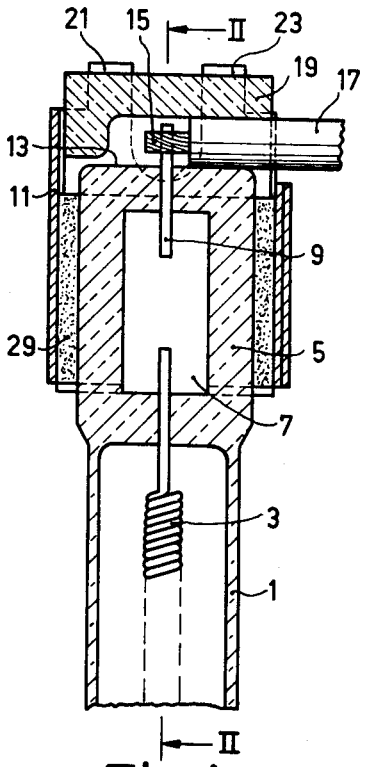

The invention relates to an electric infra-red incandescent lamp comprising a hermetically sealed tubular lamp envelope the two ends of which are sealed by a pinch seal comprising a current leadthrough which is coupled, outside the pinch seal, to the end of a current conductor from which the insulation has been removed, said coupling place, as well as the pinch seal, being surrounded by a metal sleeve serving as a lamp cap. Such an electric incandescent lamp is known from Canadian patent specification No. 553,560. The known lamp serves as an infra-red radiation member the two ends of which comprise at their pinch seals a metal sleeve from which outgoing conductors emanate. The lamp caps in the known lamps convey current and are therefore not safe to touch. In addition, the operating temperature of this type of lamp caps is very high, in the order of 350° C.

It is the object of the invention, starting from the known construction, to provide an incandescent lamp of the infra-red type the lamp caps of which are electrically safe to touch and the operating temperature of which is low.

The electric incandescent lamp of the infra-red type which satisfies this object is characterized in that a mass of cement of a readily heat-conducting material is provided between the pinch seal and the wall of the sleeve surrounding same, a member of electrically insulating material being incorporated in the sleeve at its ends remote from the lamp envelope, said member surrounding the said connection place in an electrically insulating manner relative to the sleeve and closing the passage between the sleeve and the pinch seal entirely or substantially entirely. So in this case a cement is used which fills the space between the pinch seal and the sleeve. Said space should preferably be filled entirely with the heat-dissipating mass; air inclusions are to be avoided as much as possible. In this manner the heat dissipation can be extremely large. As a cement may be used any inorganic cement mass in which in certain circumstances finely divided metal powder may be incorporated, if desired. In this manner it is possible to reach considerably reduced pinch temperatures. The operating temperature of a pinch seal which has a tight-fitting sleeve but without cement being 350° C, said temperature may be reduced to even 175° C by using a heat-conducting cement filling the space between the sleeve and the pinch seal. It is to be noted that the use of cement masses which are heat-conducting is known per se, for which purpose reference is made to British patent specification No. 966,914. The cement described in said Patent specification is organic and the use thereof is recommended for low-pressure mercury vapour discharge lamps having a considerably lower operating temperature at their pinch seals. The member which is manufactured of an insulating material which is incorporated in the part of the sleeve which is farthest remote from the pinch seal has such a shape that the readily heat-conducting material cannot penetrate to the coupling place where the end of a current conductor from which the insulation has been removed is secured to the current lead through emanating from the pinch seal. In this manner an efficacious electric insulation of the metal sleeve is obtained.

Although in the above-described construction current conductors might be used which emanate axially from the sleeve, the sleeve is formed as a sheath having lugs extending in the longitudinal direction of the lamp and bent around the member of insulating material. As a result of this the structural length of the lamp is relatively short.

According to a further preferred embodiment of the lamp according to the invention the sleeve has a rectangular cross-section, the largest surfaces extending parallel to the corresponding surfaces of the pinch seal. By choosing this shape of the sleeve, a lamp cap is obtained which shows two large surfaces which can be incorporated in a holder which is constructed so that on said surfaces a large heat dissipation towards the holder can take place. It has been found that in combination with air cooling means the temperature of the lamp cap in normal operating conditions of the infra-red incandescent lamp can even be reduced to approximately 40° C.

The invention furthermore provides a device, in particular an infra-red radiation device, in which at least one lamp as described above and constructed as an infra-red incandescent lamp can be secured to its ends, the said device comprising a reflector part extending parallel to the longitudinal direction of the lamp. The device in question comprises two side walls of readily heat-conducting material each having at least one slot in which the lamp can be incorporated with its sleeve-like lamp caps, contact means being present to hold the ends of the lamps in a resilient and heat-dissipating manner.

The invention will be described briefly with reference to the drawing, in which

Figure 2:
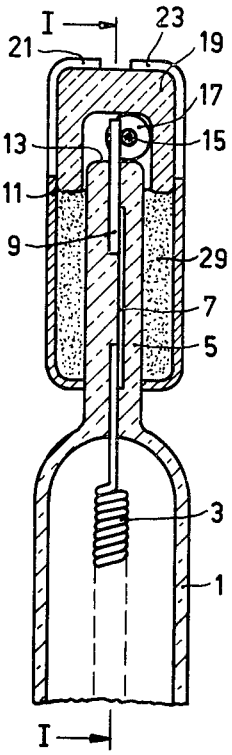
Figure 4:
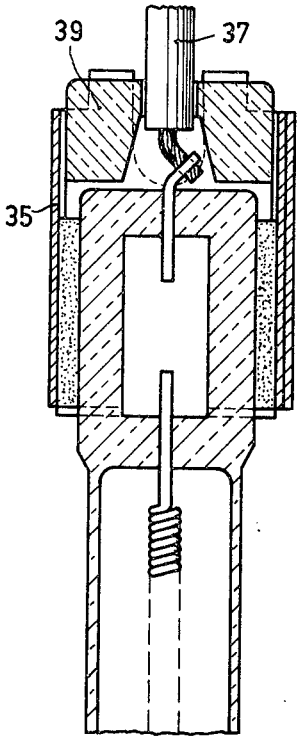
Figure 3:
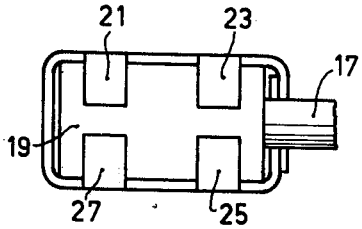
Figure 5:
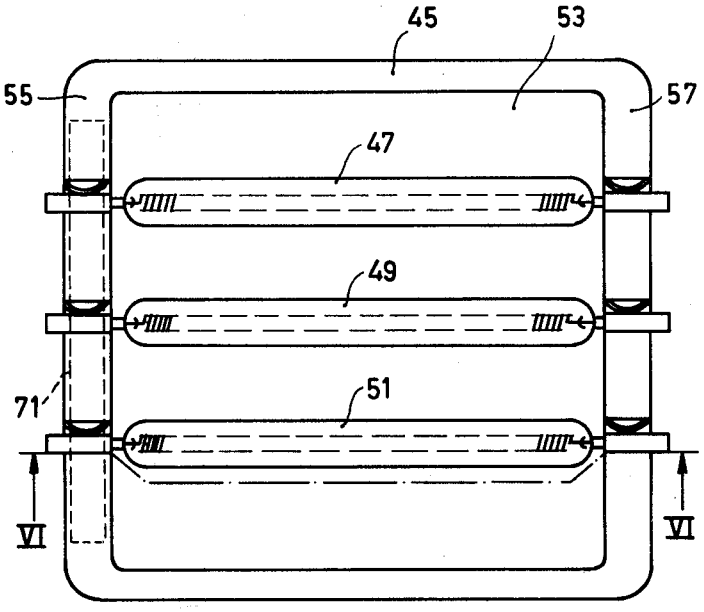
Figure 7:
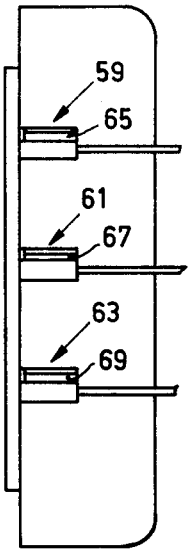
Figure 6:
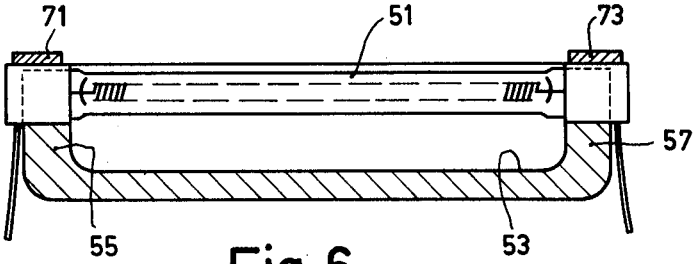

FIG. 1 is a longitudinal sectional view through a part of an infra-red incandescent lamp according to a first embodiment, FIG. 2 is a sectional view taken on the line II—II of FIG. 1, FIG. 3 is a plan view of the lamp shown in FIG. 1, FIG. 4 is a longitudinal sectional view through a part of an infra-red incandescent lamp according to a second embodiment, FIG. 5 is a plan view of a luminaire for incorporating the lamp shown in FIG. 1, FIG. 6 is a sectional view taken on the line VI—VI of FIG. 5, and FIG. 7 is a side elevation of the luminaire shown in FIG. 5.

The incandescent lamp shown in FIGS. 1, 2 and 3 is of the infra-red type. It comprises a tubular lamp envelope 1 of quartz glass in which a filament 3 of tungsten is arranged which is secured in a pinch seal 5 at either end. Said pinch seal comprises a foil 7 of molybdenum to which a molybdenum lead through rod 9 is secured. Only one end of the lamp is shown, the other end being identical.

The pinch seal 5 is surrounded by a sleeve 11 of aluminium extending to beyond the end 13 of the seal 5. At that area the rod 9 is welded to the end 15 of a current conductor 17 from which the insulation jacket has been removed. Said conductor 17 is enclosed between the end 13 of the pinch seal 5 and a body 19 of ceramic material. The sleeve 11 furthermore comprises four lugs 21, 23, 25, 27 which are bent around the ceramic member 19. Said ceramic member 19 therefore surrounds the coupling place of the rod 9 and the end 15. In this manner a lamp cap is obtained the conductor 1 of which is fixed in a tension free manner.

Since the sleeve 11 does not convey current, it is electrically safe to touch.

The space between the sleeve 11 and the pinch seal 5 is furthermore filled entirely with a readily heat-conducting cement mass 29 which, due to the design of the ceramic member 19, cannot penetrate to the above-mentioned electric coupling place. As a cement mass is preferably used an inorganic cement in which finely divided metal powder is incorporated, if desired. Due the absence of air inclusions between the sleeve 11 and the pinch seal 5, the thermal energy at the pinch seal of the operating lamp can be dissipated efficaciously to the sleeve 11. It has been found that the temperature of said sleeve can be kept very low, for example 40° C, by further contact with a larger mass of metal, see FIGS. 5, 6, 7 possibly while using air cooling.

The lamp shown has very short lamp caps, also since the conductor 17 is oriented at right angles to the length of the lamp.

The embodiment shown in FIG. 4 is used in those cases in which conductors 37 emanating axially from a sleeve are desired. The conduction of this lamp is substantially identical to the lamp shown in FIGS. 1, 2 and 3. The ceramic member has a different shape and is denoted by 39.

The infra-red heating device shown diagrammatically in FIGS. 5, 6, 7 is constructed as a box-like luminaire 45 of metal in which three lamps 47, 49 and 51 as shown in FIGS. 1, 2, 3 are accommodated. The luminaire comprises a flat bottom 53 of which the surface facing the lamps is reflective. Slots in which leaf springs are present are recessed in the side walls 55 and 57. Said slots are denoted for one side in FIG. 7 by 59, 61 and 63 with springs 65, 67 and 69. The lamp caps of the lamps 47, 49 and 51 are accommodated in the said slots and that in such manner that the flat sides of the metal sleeves of the lamp caps are in direct contact with the leaf springs and the flat wall of the slots. The lamp caps are covered by strips 71 and 73 of which one is shown in broken lines in FIG. 5.

The said heating device has a compact structure. The assembly of the lamps is very simple. After detaching the strips 71 and 73 the lamps can be arranged immediately in the slots. Furthermore, said device is free from vibrations. Furthermore, the lamps arranged in the slots can expand axially in a substantially stress-free manner.

What is claimed is:

1. An electric infra-red incandescent lamp which comprises a hermetically sealed lamp envelope, at least one extremity of said envelope being sealed by a pinch seal; a current lead through extending outside said pinch seal and said envelope; a current conductor connected outside said pinch to said current lead through; a metal sleeve surrounding in circumferentially spaced relation substantially all of the connection between said current lead through and said current conductor as well as said pinch seal; a mass of a readily heat-conducting material substantially filling all of the space between said pinch seal and the interior of said metal sleeve, an electrically insulating member cooperating with said sleeve at the end thereof remote from the lamp envelope, said member surrounding said connection and closing said sleeve.

2. An electric lamp as claimed in claim 1 wherein the mass of readily heat-conducting material is a cement containing finely divided metal powder.

3. An electric lamp as claimed in claim 1 wherein said electrically insulating member is formed from a ceramic material and the current conductor emanates from said sleeve at right angles to the longitudinal direction of the lamp and is disposed in a plane which is located in the plane of said pinch seal.

4. An electric lamp as claimed in claim 1 wherein said sleeve further includes lugs extending around said electrically insulating member.

5. An electric lamp as claimed in claim 1 characterized in that the sleeve has a rectangular cross-section and the largest surfaces thereof are disposed in parallel relationship to the sides of said pinch seal.

6. An infrared radiation device which comprises at least one lamp as claimed in claim 1, said lamp being elongated and mounted at the ends thereof, said device further including a reflector extending parallel to the longitudinal axis of said lamp, said reflector having two side walls of a readily heat-conducting material, each of said walls having at least one slot having contact means cooperating with said metal sleeve to hold at least one end of each lamp in a resilient and heat-dissipating member.

* * * * *